US009267398B2

(12) United States Patent
Shiozawa et al.

(10) Patent No.: US 9,267,398 B2
(45) Date of Patent: Feb. 23, 2016

(54) VARIABLE VALVE TIMING CONTROL DEVICE OF INTERNAL COMBUSTION ENGINE

(71) Applicant: NISSAN MOTOR CO., LTD., Yokohama-shi, Kanagawa (JP)

(72) Inventors: Ken Shiozawa, Yamato (JP); Hironori Ito, Ebina (JP); Kenji Ariga, Fujisawa (JP); Hiroyuki Itoyama, Yokohama (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 0 days.

(21) Appl. No.: 14/374,319

(22) PCT Filed: Feb. 13, 2013

(86) PCT No.: PCT/JP2013/053393

§ 371 (c)(1),
(2) Date: Jul. 24, 2014

(87) PCT Pub. No.: WO2013/129110

PCT Pub. Date: Sep. 6, 2013

(65) Prior Publication Data

US 2014/0366825 A1 Dec. 18, 2014

(30) Foreign Application Priority Data

Feb. 29, 2012 (JP) ..... 2012-042671

(51) Int. Cl.
*F01L 1/34* (2006.01)
*F01L 1/344* (2006.01)

(52) U.S. Cl.
CPC ..... *F01L 1/3442* (2013.01); *F01L 2001/34423* (2013.01); *F01L 2001/34426* (2013.01); *F01L 2001/34453* (2013.01);

(Continued)

(58) Field of Classification Search
CPC ..... F01L 1/3442; F01L 2001/34426; F01L 2001/34453; F01L 2001/34463; F01L 2001/34466
USPC ..... 123/90.17
See application file for complete search history.

(56) References Cited

U.S. PATENT DOCUMENTS

| | | | | |
|---|---|---|---|---|
| 6,330,870 | B1 * | 12/2001 | Inoue et al. | 123/90.17 |
| 8,297,245 | B2 | 10/2012 | Urushihata | |
| 2002/0038640 | A1 | 4/2002 | Fujiwaki et al. | |
| 2010/0139592 | A1 * | 6/2010 | Takemura | 123/90.17 |

(Continued)

FOREIGN PATENT DOCUMENTS

| | | | |
|---|---|---|---|
| EP | 2 388 446 | A1 | 11/2011 |
| EP | 2 418 360 | A1 | 2/2012 |

(Continued)

*Primary Examiner* — Zelalem Eshete
(74) *Attorney, Agent, or Firm* — Drinker Biddle & Reath LLP

(57) ABSTRACT

When an intermediate lock by an intermediate lock mechanism is released, one of two lock keys, which restricts a shift in a direction opposite to a direction that valve timing of an intake valve has been controlled by controlling the valve timing of the intake valve to a phase-advance side with respect to an intermediate lock position, is pulled out of an engaging recessed portion. Thereafter, the other of the two lock keys is pulled out of an engaging recessed portion by controlling the valve timing of the intake valve to a phase-retard side with respect to the intermediate lock position. Therefore, the intermediate lock by the intermediate lock mechanism can be released, while avoiding the lock keys from being pushed against the respective engaging recessed portions.

5 Claims, 7 Drawing Sheets

(52) U.S. Cl.
CPC ..... *F01L 2001/34459* (2013.01); *F01L 2001/34463* (2013.01); *F01L 2001/34466* (2013.01); *F01L 2001/34473* (2013.01); *F01L 2250/02* (2013.01); *F01L 2250/04* (2013.01); *F01L 2800/00* (2013.01)

(56) References Cited

U.S. PATENT DOCUMENTS

2010/0294223 A1* 11/2010 Adachi et al. ..... 123/90.17

FOREIGN PATENT DOCUMENTS

| | | | |
|---|---|---|---|
| JP | 2001-055935 | A | 2/2001 |
| JP | 2002-349220 | A | 12/2002 |
| JP | 2009-133263 | A | 6/2009 |
| JP | 2010-138732 | A | 6/2010 |
| JP | 2011-038446 | | 2/2011 |
| JP | 2011-038446 | A | 2/2011 |
| JP | 2011-179385 | A | 9/2011 |
| JP | 2011-208497 | A | 10/2011 |
| JP | 2012-026271 | A | 2/2012 |

* cited by examiner

VARIABLE VALVE TIMING CONTROL DEVICE OF INTERNAL COMBUSTION ENGINE

TECHNICAL FIELD

The present invention relates to a variable valve timing control device of an internal combustion engine.

BACKGROUND ART

A variable valve timing device of an internal combustion engine, which is provided with an intermediate lock mechanism that enables a phase of a camshaft relative to a crankshaft to be locked at an intermediate phase, is well known in the art.

For instance, the variable valve timing device of the internal combustion engine, disclosed in Patent document 1, has a housing configured to rotate in synchronism with the crankshaft, a rotor installed in the housing and configured to rotate together with the camshaft, and two lock pins, each of which is configured to be engageable with both the housing and the rotor. Also disclosed is an intermediate lock mechanism configured to restrict relative rotation of the camshaft with respect to the crankshaft and hold valve timing at a predetermined intermediate lock position, by inserting the top ends of the two lock pins from the housing side into respective lock grooves formed in the rotor.

The variable valve timing device of the Patent document 1 is configured to be changeable the valve timing by supplying operating oil (working hydraulic fluid) to a phase-advance side hydraulic chamber or a phase-retard side hydraulic chamber, defined between the housing and the rotor. When the intermediate lock mechanism is released, working hydraulic fluid is supplied repeatedly into the phase-advance side hydraulic chamber and the phase-retard side hydraulic chamber in turn, prior to hydraulically pushing the lock pins back to the housing side.

Therefore, in the Patent document 1, valve timing becomes kept stably at the intermediate lock position, so as to establish a specific state where relative rotation of the housing and the rotor from the intermediate lock position can be suppressed. Hence, it is possible to reduce frictional forces between each individual lock pin and each of the housing and the rotor, caused by the lock pins, each pushed against the housing and the rotor, thereby enabling the two lock pins to be easily pulled out of the respective lock grooves.

However, it is difficult to exactly equalize the hydraulic pressure in the phase-advance side hydraulic chamber with the hydraulic pressure in the phase-retard side hydraulic chamber by supplying working fluid repeatedly to the phase-advance side hydraulic chamber and the phase-retard side hydraulic chamber in turn. Therefore, due to individual differences of component parts, there is a possibility that the frictional forces between these component parts, caused by the lock pins, each pushed against the housing and the rotor, undesirably increase and thus the release of the intermediate lock mechanism fails.

Additionally, in the case of the intermediate lock mechanism having two lock pins, suppose that the hydraulic pressure in the phase-advance side hydraulic chamber is not exactly equalized to the hydraulic pressure in the phase-retard side hydraulic chamber. One of the two lock pins tends to be necessarily pushed against the housing and the rotor. Therefore, there is a very strong possibility that the release of the intermediate lock mechanism may fail.

CITATION LIST

Patent Literature

Patent document 1: Japanese Patent Provisional Publication No. 2002-349220

SUMMARY OF INVENTION

A variable valve timing control device of an internal combustion engine according to the invention is equipped with a variable valve timing mechanism configured to change valve timing of an engine valve, and an intermediate lock mechanism configured to enable an intermediate lock that holds the valve timing at a predetermined intermediate lock position.

In the invention, the intermediate lock mechanism has a phase-advance side intermediate-position holding member and a phase-retard side intermediate-position holding member, each of which is configured to engage with a first rotor and a second rotor of the variable valve timing mechanism. The phase-advance side intermediate-position holding member is provided for restricting a shift of valve timing from the intermediate lock position to a phase-advance side. The phase-retard side intermediate-position holding member is provided for restricting a shift of the valve timing from the intermediate lock position to a phase-retard side.

When the intermediate lock by the intermediate lock mechanism is released, a first intermediate lock release is executed such that one intermediate-position holding member of the two intermediate-position holding members, which restricts a shift in a direction opposite to a direction that the valve timing of the engine valve has been controlled by controlling the valve timing to the phase-advance side or to the phase-retard side with respect to the intermediate lock position, moves out of engagement with the first rotor and the second rotor. Thereafter, a second intermediate lock release is executed such that the other intermediate-position holding member of the two intermediate-position holding members moves out of engagement with the first rotor and the second rotor by controlling the valve timing of the engine valve in the direction opposite to the direction that the valve timing of the engine valve has been controlled during the first intermediate lock release.

According to the invention, an intermediate lock by the intermediate lock mechanism can be released such that there is no occurrence of frictional forces between component parts, caused by these two intermediate-position holding members, each pushed against the housing and the rotor. Hence, it is possible to suppress the release of the intermediate lock from failing.

DESCRIPTION OF EMBODIMENTS

Figure 1:
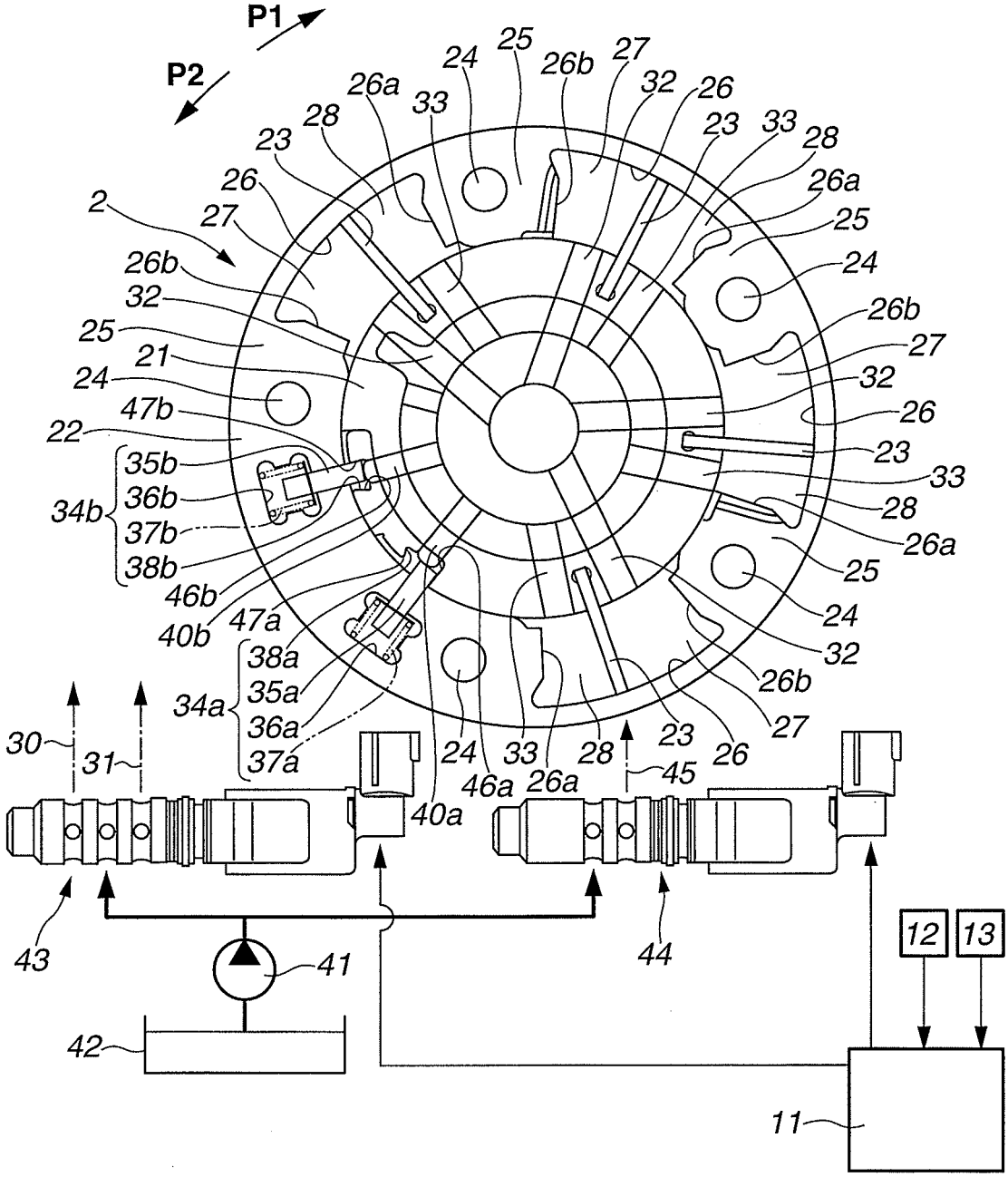
FIG. 1 is an explanatory view illustrating the schematic system configuration of a variable valve timing control device of an internal combustion engine according to the invention.

One embodiment of the invention is hereinafter described in reference to the drawings. FIG. 1 is the explanatory view illustrating the schematic system configuration of a variable valve timing control device of an internal combustion engine according to the invention. A variable valve timing mechanism 2 of this variable valve timing control device is configured to continuously variably control a rotational phase difference between a crankshaft (not shown) and a camshaft (not shown) by working-fluid supply, such that valve timing (a phase of the central angle of a valve lift) of an engine valve (not shown intake or exhaust valves) can be variably adjusted within a predetermined range. In the shown embodiment, the variable valve timing mechanism 2 is applied to the intake-valve side.

As shown in FIG. 1, variable valve timing mechanism 2 is equipped with an inner rotor 21 (a first rotor) and an outer rotor 22 (a second rotor) fitted to the inner rotor 21 in a manner so as to be relatively rotatable with respect to the inner rotor.

Inner rotor 21 is fixedly connected to the axial end of an intake camshaft (not shown) rotatably supported on a cylinder block (not shown) of the internal combustion engine, such that the inner rotor and the intake camshaft rotate integrally with each other. When the intake camshaft rotates together with the inner rotor 21, the intake valves are operated (opened and closed) by means of cams (not shown) attached onto the intake camshaft. Four vanes 23 are radially installed on the outer periphery of inner rotor 21.

Outer rotor 22 is coaxially arranged on the outer peripheral side of inner rotor 21. Outer rotor 22 is fixedly connected to an intake cam sprocket (not shown) by means of a plurality of mounting bolts 24. The intake cam sprocket is linked to the crankshaft through a timing chain (not shown) or a timing belt (not shown).

The inner periphery of outer rotor 22 is formed with protruding portions 25 having the same number (i.e., four) of vanes 23 of inner rotor 21. Vanes 23 are accommodated in respective recessed portions 26, defined by each two adjacent protruding portions 25.

The tip of each vane 23 is kept in sliding-contact with the inner periphery of the recessed portion 26, whereas the tip of each protruding portion 25 is kept in sliding-contact with the outer periphery of inner rotor 21. As a result of this, a group of the inner rotor 21 and the intake camshaft and a group of the intake cam sprocket and the outer rotor 22 are rotatable relatively to each other about the same central rotation axis.

Also, two spaces 27, 28, partitioned by the vane 23, are defined in the recessed portion 26 in a fluid-tight fashion. The space 28 of these two spaces 27-28, located on the side of the rotation direction (the direction indicated by the arrow P1) of the intake camshaft with respect to the vane 23, serves as a phase-retard side hydraulic chamber, whereas the space 27, located on the opposite side (the direction indicated by the arrow P2), serves as a phase-advance side hydraulic chamber.

Oil passages 32, each communicating with a phase-advance side oil passage 30, and oil passages 33, each communicating with a phase-retard side oil passage 31, are formed in the inner rotor 21.

In the shown embodiment, when a phase of outer rotor 22 relative to inner rotor 21 is advanced to a maximum in the direction indicated by the arrow P1 by working-fluid supply from the phase-advance side oil passage 30 to the phase-advance side hydraulic chamber 27, in other words, when the vane 23 is brought into abutted-engagement with one end face 26*a* of two opposed end faces of the recessed portion 26 or a stopper (not shown) located on the side of the end face 26*a*, valve timing of the intake valve becomes a maximum phase-advanced state. A valve-timing position of the intake valve under this state corresponds to a maximum phase-advance position. In contrast, when a phase of outer rotor 22 relative to inner rotor 21 is advanced to a maximum in the direction indicated by the arrow P2 by working-fluid supply from the phase-retard side oil passage 31 to the phase-retard side hydraulic chamber 28, in other words, when the vane 23 is brought into abutted-engagement with the other end face 26*b* of the two opposed end faces of the recessed portion 26 or a stopper (not shown) located on the side of the end face 26*b*, valve timing of the intake valve becomes a maximum phase-retarded state. A valve-timing position of the intake valve under this state corresponds to a maximum phase-retard position. In the shown embodiment, when the valve timing of the intake valve is kept at a predetermined intermediate lock position between the maximum phase-advance position and the maximum phase-retard position, a relative rotational phase between inner rotor 21 and outer rotor 22 is held by means of intermediate lock mechanisms 34*a*, 34*b*, which are installed between inner rotor 21 and outer rotor 22.

Intermediate lock mechanism 34*a* is a phase-advance side intermediate lock mechanism configured to restrict a shift of inner rotor 21 in the phase-advance direction (the direction indicated by the arrow P1), whereas intermediate lock mechanism 34*b* is a phase-retard side intermediate lock mechanism configured to restrict a shift of inner rotor 21 in the phase-retard direction (the direction indicated by the arrow P2). Also, in the shown embodiment, the phase-advance side intermediate lock mechanism 34*a* and the phase-retard side intermediate lock mechanism 34*b* are configured similarly to each other.

Phase-advance side intermediate lock mechanism 34*a* is mainly constructed by a lock key 35*a*, a lock key accommodation chamber 36*a*, a coil spring 37*a*, and an engaging recessed portion 38*a*. The lock key serves as an elongated intermediate-position holding member, which is configured to advance or retreat in the direction perpendicular to the rotation axis common to inner rotor 21 and outer rotor 22. The lock key accommodation chamber is formed in the protruding portion 25 of outer rotor 22. The coil spring is located in the lock key accommodation chamber 36*a* for permanently biasing the lock key 35*b* toward the inner rotor 21. The engaging recessed portion is configured to be brought into engagement with the top end of lock key 35*a*. Hereupon, a circumferential length of engaging recessed portion 38*a*, measured along the circumferential direction of inner rotor 21, is formed or dimensioned to be longer than a circumferential length of the top end of lock key 35*a*, measured along the circumferential direction of inner rotor 21. With the previously-noted arrangement, bringing the top end of lock key 35*a* into engagement with a phase-advance side sidewall surface 46*a* of engaging recessed portion 38*a* at the intermediate lock position, restricts a shift of the relative rotational phase between inner rotor 21 and outer rotor 22 from the predetermined intermediate phase to the phase-advance side. Also, at the intermediate lock position, a phase-retard side sidewall surface 47*a* of engaging recessed portion 38*a* is spaced apart from the top end of lock key 35*a* located in the engaging recessed portion 38*a* by a predetermined distance along the circumferential direction of inner rotor 21. By the way, working fluid can be supplied into the engaging recessed portion 38*a* through an oil passage 40*a* formed in the inner rotor 21. Also, working fluid in the engaging recessed portion 38*a* can be drained (exhausted) through the oil passage 40*a*.

As previously discussed, phase-retard side intermediate lock mechanism 34*b* is configured similarly to phase-advance side intermediate lock mechanism 34*a*. Phase-retard side intermediate lock mechanism 34*b* is mainly constructed by a lock key 35*b*, a lock key accommodation chamber 36*b*, a coil spring 37*b*, and an engaging recessed portion 38*b*. The lock key serves as an elongated intermediate-position holding member, which is configured to advance or retreat in the direction perpendicular to the rotation axis common to inner rotor 21 and outer rotor 22. The lock key accommodation chamber is formed in the protruding portion 25 of outer rotor 22. The coil spring is located in the lock key accommodation chamber 36*b* for permanently biasing the lock key 35*a* toward the inner rotor 21. The engaging recessed portion is configured to be brought into engagement with the top end of lock key 35*b*. Hereupon, a circumferential length of engaging recessed portion 38*b*, measured along the circumferential direction of inner rotor 21, is formed or dimensioned to be longer than a circumferential length of the top end of lock key 35*b*, measured along the circumferential direction of inner rotor 21. With the previously-noted arrangement, bringing the top end of lock key 35*b* into engagement with a phase-retard side sidewall surface 47*b* of engaging recessed portion 38*b* at the intermediate lock position, restricts a shift of the relative rotational phase between inner rotor 21 and outer rotor 22 from the predetermined intermediate phase to the phase-retard side. Also, at the intermediate lock position, a phase-advance side sidewall surface 46*b* of engaging recessed portion 38*b* is spaced apart from the top end of lock key 35*b* located in the engaging recessed portion 38*b* by a predetermined distance along the circumferential direction of inner rotor 21. By the way, working fluid can be supplied into the engaging recessed portion 38*b* through an oil passage 40*b* formed in the inner rotor 21. Also, working fluid in the engaging recessed portion 38*b* can be drained (exhausted) through the oil passage 40*b*.

That is, restricting a shift of the relative rotational phase between inner rotor 21 and outer rotor 22 from the predetermined intermediate phase by means of the intermediate lock mechanisms 34*a*, 34*b*, enables valve timing of the intake valve to be held at the intermediate lock position.

Variable valve timing mechanism 2 is driven by working fluid from an oil pump 41. Oil pump 41 is driven mechanically by a rotational force of the crankshaft so as to draw working fluid in an oil pan 42. The working fluid is supplied from the oil pump 41 to both an oil control valve (OCV) 43 and an oil switching valve (OSV) 44. Oil control valve 43 and oil switching valve 44 are control valves, which are duty-controlled based on or responsively to respective commands from an ECM (engine control module) 11.

Oil control valve 43 is configured to supply working fluid through the phase-advance side oil passage 30 to the phase-advance side hydraulic chamber 27, and also configured to supply working fluid through the phase-retard side oil passage 31 to the phase-retard side hydraulic chamber 28. Oil switching valve 44 is configured to supply working fluid from an intermediate-position holding oil passage 45 through the oil passages 40*a*, 40*b* to the engaging recessed portions 38*a*, 38*b* of intermediate lock mechanisms 34*a*, 34*b*. By the way, in the shown embodiment, oil switching valve 44 is configured to have a valve structure similar to the oil control valve 43, but differing from the oil control valve in that a port, which port is brought into fluid-communication with the phase-advance side oil passage 30 during a phase-advance period, is permanently sealed.

ECM 11 is configured to receive detected signals from a variety of sensors, such as a crank angle sensor 12 for detecting a rotation angle of the crankshaft, a cam angle sensor for detecting a rotation angle of the intake camshaft, and the like, so as to sequentially update and calculate a desired value of valve timing of the intake valve based on an engine operating condition, grasped by the detection results of these sensors. ECM 11 is also configured to output a command signal to the oil control valve 43 responsively to the engine operating condition, so as to perform switching control of oil control valve 43. When valve timing of the intake valve is advanced, oil control valve 43 is switched so as to supply working fluid into the phase-advance side hydraulic chamber 27. Conversely when valve timing of the intake valve is retarded, oil control valve 43 is switched so as to supply working fluid into the phase-retard side hydraulic chamber 28. By the way, the valve timing of the intake valve, which is variably controlled by the variable valve timing mechanism 2, can be detected, based on output signals from crank angle sensor 12 and cam angle sensor 13, by means of the ECM 11.

Figure 2:
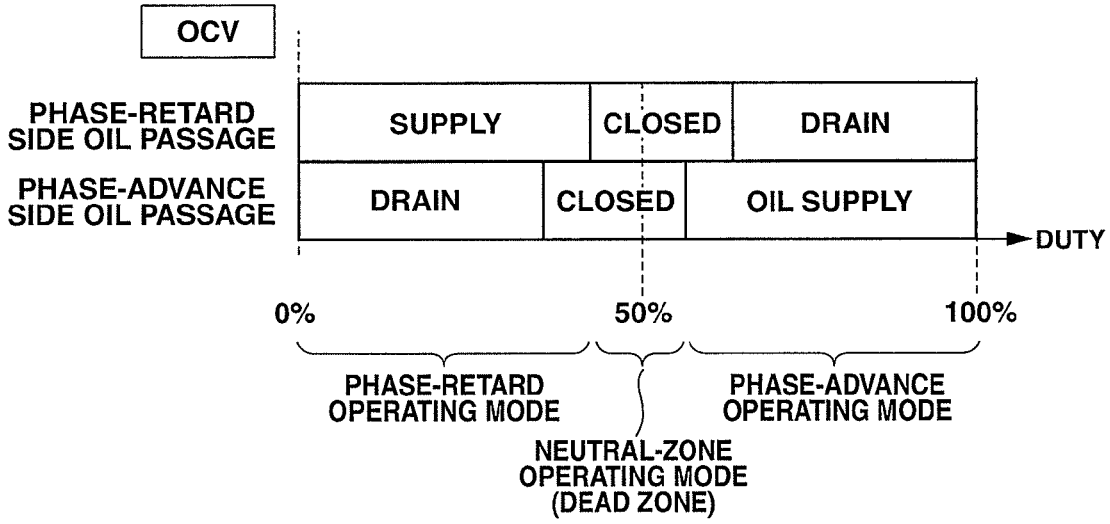
FIG. 2 is an explanatory view schematically illustrating operating states of an oil control valve and an oil switching valve with respect to a duty ratio.
Figure 2:
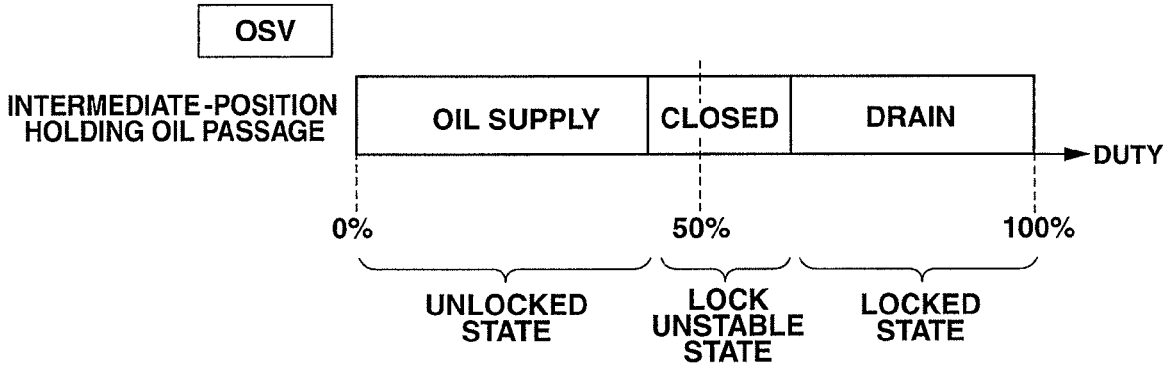

Referring to FIG. 2, there is shown the explanatory view schematically illustrating the operating states of oil control valve 43 and oil switching valve 44 with respect to a duty ratio, which is a control command value.

The operating state of oil control valve 43 is mainly classified into a phase-advance operating mode at which valve timing of the intake valve is advanced, a neutral-zone operating mode (a dead zone) that working-fluid supply to both the phase-advance side hydraulic chamber 27 and the phase-retard side hydraulic chamber 28 is not executed, and a phase-retard operating mode at which valve timing of the intake valve is retarded. During the phase-advance operating mode, working fluid is supplied to the phase-advance side hydraulic chamber 27, whereas working fluid in the phase-retard side hydraulic chamber 28 is drained (exhausted). Thus, valve timing of the intake valve is changed to the phase-advance side. During the phase-retard operating mode, working fluid is supplied to the phase-retard side hydraulic chamber 28, whereas working fluid in the phase-advance side hydraulic chamber 27 is drained (exhausted). Thus, valve timing of the intake valve is changed to the phase-retard side. During the neutral-zone operating mode, working-fluid supply to the phase-advance side hydraulic chamber 27 and the phase-retard side hydraulic chamber 28 and working-fluid drainage (exhaust) from the phase-advance side hydraulic chamber and the phase-retard side hydraulic chamber are stopped. Hence, there is no phase-change of valve timing of the intake valve to the phase-advance side or to the phase-retard side, and thus the valve timing of the intake valve can be held in the current valve-timing state.

The operating state of oil switching valve 44 is mainly classified into a locked state where valve timing of the intake valve can be held at the intermediate lock position, an unlocked state where valve timing of the intake valve cannot be held at the intermediate lock position, and a lock unstable state (lock indefinite state) that waits to be confirmed whether the intermediate lock mechanisms are put in the locked state or in the unlocked state.

In the previously-discussed locked state, working-fluid supply to the engaging recessed portions 38*a*, 38*b* is stopped, and working fluid in the engaging recessed portions 38*a*, 38*b* is drained (exhausted). Hence, a state that enables the top ends of lock keys 35*a*, 35*b* to advance into respective engaging recessed portions 38*a*, 38*b*, becomes established. Immediately when valve timing of the intake valve has reached the intermediate lock position, the top ends of lock keys 35*a*, 35*b* are brought into engagement with respective engaging recessed portions 38*a*, 38*b*, thereby enabling the valve timing of the intake valve to be held at the intermediate lock position.

In the previously-discussed unlocked state, working fluid is simultaneously supplied into both of the engaging recessed portions 38*a*, 38*b*, with the result that hydraulic pressures, which are greater than spring biases (spring forces) of coil springs 37*a*, 37*b* acting on respective lock keys 35*a*, 35*b*, occur in the engaging recessed portions 38*a*, 38*b*. Hence, a state that disables the top ends of lock keys 35*a*, 35*b* to advance into respective engaging recessed portions 38*a*, 38*b*, becomes established. Even when valve timing of the intake valve has reached the intermediate lock position, the valve timing of the intake valve cannot be held at the intermediate lock position, and thus the intermediate lock by intermediate lock mechanisms 34*a*, 34*b* is released.

In the previously-discussed lock unstable state, a state that inhibits working-fluid supply into the engaging recessed portions 38*a*, 38*b* and working-fluid drainage (exhaust) from the engaging recessed portions becomes established. Hydraulic pressures in the engaging recessed portions 38*a*, 38*b* are held at pressure levels (in hydraulic-pressure states) immediately before a transition to the lock unstable state. Therefore, there are two cases, one being the case that the top ends of lock keys 35*a*, 35*b* are brought into engagement with respective engaging recessed portions 38*a*, 38*b*, and the other being the case that the top ends of lock keys 35*a*, 35*b* are not brought into engagement with respective engaging recessed portions 38*a*, 38*b*.

By the way, in the variable valve timing mechanism 2 having the previously-discussed construction, in the presence of a pressure difference between hydraulic pressure in the phase-advance side hydraulic chamber 27 and hydraulic pressure in the phase-retard side hydraulic chamber 28 under a state where valve timing of the intake valve is held at the intermediate lock position by means of the intermediate lock mechanisms 34*a*, 34*b*, one of lock keys 35*a*, 35*b* is pushed against the sidewall of the associated engaging recessed portion 38 and the sidewall of the associated lock key accommodation chamber 36.

For instance, when the hydraulic pressure in the phase-advance hydraulic chamber 27 is higher than the hydraulic pressure in the phase-retard hydraulic chamber 28, valve timing of the intake valve is shifted to the phase-advance side with respect to the intermediate lock position. Thus, a part of the top end of lock key 35*a* is pushed against the engaging recessed portion 38*a*, while a part of the back end of lock key 35*a* is pushed against the lock key accommodation chamber 36*a*.

Therefore, owing to frictional forces, caused by frictional-contact portions of lock key 35*a*, pushed against the engaging recessed portion 38*a* and the lock key accommodation chamber 36*a*, movement of the lock key in a direction (in the direction perpendicular to the rotation axis common to inner rotor 21 and outer rotor 22) such that the lock key is pulled out of the engaging recessed portion 38*a* is restricted. That is to say, assuming that the intermediate lock by the intermediate lock mechanisms 34*a*, 34*b* is released under the previously-noted restricted condition, there is a possibility that lock key 35*a* cannot be satisfactorily pulled out of the engaging recessed portion 38*a*.

Also, on the assumption that it is possible to hold valve timing of the intake valve at the intermediate lock position under a state where there is no pressure difference between hydraulic pressure in the phase-advance side hydraulic chamber 27 and hydraulic pressure in the phase-retard side hydraulic chamber 28, there is a less possibility both of the lock keys 35*a*, 35*b* may be pushed against the sidewall of the associated engaging recessed portion 38 and the sidewall of the associated lock key accommodation chamber 36. However, it is difficult to exactly equalize the hydraulic pressure in the phase-advance side hydraulic chamber 27 and the hydraulic pressure in the phase-retard side hydraulic chamber 28 with each other.

For that reason, in the shown embodiment, when releasing the locked state where valve timing of the intake valve is held at the intermediate lock position by means of the intermediate lock mechanisms 34*a*, 34*b* (that is, when releasing the previously-discussed intermediate lock), first of all, a first intermediate lock release is executed such that the top end of one lock key 35 of the two lock keys, which restricts a shift in a direction opposite to a direction that the valve timing of the intake valve has been controlled by controlling the valve timing of the intake valve to the phase-advance side or to the phase-retard side with respect to the intermediate lock position, moves out of engagement with the engaging recessed portion 38. After the first intermediate lock release, a second intermediate lock release is executed such that the top end of the other lock key 35 of the two lock keys moves out of engagement with the engaging recessed portion 38 by controlling the valve timing of the intake valve in the direction opposite to the direction that the valve timing of the intake valve has been controlled during the first intermediate lock release.

Figure 3:
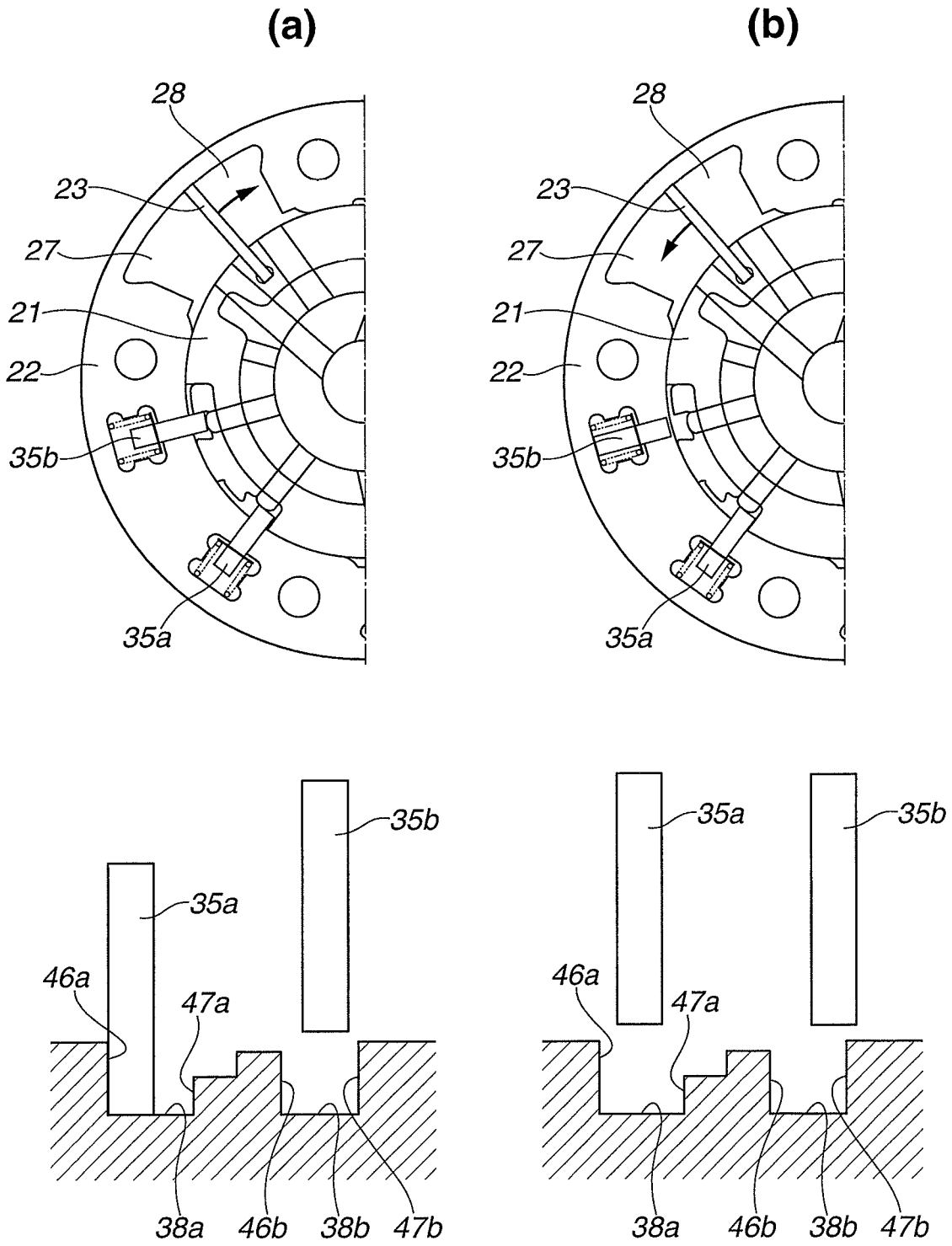
FIG. 3 is an explanatory view schematically illustrating releasing of an intermediate lock according to the invention, FIG. 3(*a*) showing a first intermediate lock release by which an intermediate lock of a phase-retard side intermediate lock mechanism is released, and FIG. 3(*b*) showing a second intermediate lock release by which an intermediate lock of a phase-advance side intermediate lock mechanism is released.

Referring to FIG. 3, there is shown the explanatory view schematically illustrating two releasing actions, one being a releasing action that an intermediate lock of the phase-retard side intermediate lock mechanism 34*b* is released as the first intermediate lock release, and the other being a releasing action that an intermediate lock of the phase-advance side intermediate lock mechanism 34*a* is released as the second intermediate lock release.

First of all, as shown in FIG. 3(*a*), valve timing of the intake valve is controlled to the phase-advance side with respect to the intermediate lock position, and thus a state where a part of the top end of lock key 35*a* of phase-advance side intermediate lock mechanism 34*a* has been pushed against the phase-advance side sidewall surface 46*a* of engaging recessed portion 38*a* becomes established. Thereafter, the top end of lock key 35*b* of phase-retard side intermediate lock mechanism 34*b* is pulled out of the engaging recessed portion 38*b*, and thus the intermediate lock of the phase-retard side intermediate lock mechanism 34*b* is released.

When valve timing of the intake valve is controlled to the phase-advance side with respect to the intermediate lock position, vane 23 is going to move in the direction indicated by the arrow in FIG. 3(*a*) and hence the relative rotational phase between inner rotor 21 and outer rotor 22 is going to change. Accordingly, the phase-advance side sidewall surface 46*a* of engaging recessed portion 38*a* is going to move toward the lock key 35*a*. As a result, a part of the top end of lock key 35*a* is pushed against the phase-advance side sidewall surface 46*a* of engaging recessed portion 38*a*, while a part of the back end of lock key 35*a* is pushed against the sidewall surface of lock key accommodation chamber 36*a*. On the other hand, the phase-retard side sidewall surface 47*b* of engaging recessed portion 38*b* tends to move apart from the lock key 35*b*, and hence the top end of lock key 35*b* is not pushed against the phase-retard side sidewall surface 47*b* of engaging recessed portion 38*b*.

Therefore, by virtue of the first intermediate lock release, it is possible to pull the top end of lock key 35*b* out of the engaging recessed portion 38*b*, minimizing frictional forces between the lock key 35*b* and each of the engaging recessed portion 38*b* and the lock key accommodation chamber 36*b*.

By the way, the timing, at which the top end of lock key 35*b* is pulled out of the engaging recessed portion 38*b* by the first intermediate lock release, is delayed a given time after the top end of lock key 35*a* has already been pushed against the phase-advance side sidewall surface 46*a* of engaging recessed portion 38*a*. Therefore, oil switching valve 44 is controlled such that switching from the locked state to the unlocked state occurs under a state where the top end of lock key 35*a* has been pushed against the phase-advance side sidewall surface 46*a* of engaging recessed portion 38*a* due to the first intermediate lock release.

Next, as shown in FIG. 3(*b*), valve timing of the intake valve is controlled to the phase-retard side with respect to the intermediate lock position, and thus a state where a part of the top end of lock key 35*a* has been pushed against the phase-advance side sidewall surface 46*a* of engaging recessed portion 38*a* becomes released. Thereafter, the top end of lock key 35*a* of phase-advance side intermediate lock mechanism 34*a* is pulled out of the engaging recessed portion 38*a*, and thus the intermediate lock of the phase-advance side intermediate lock mechanism 34*a* is released.

When valve timing of the intake valve is controlled to the phase-retard side with respect to the intermediate lock position, vane 23 is going to move in the direction indicated by the arrow in FIG. 3(*b*) and hence the relative rotational phase between inner rotor 21 and outer rotor 22 is going to change. Accordingly, the phase-advance side sidewall surface 46*a* of engaging recessed portion 38*a* is going to move apart from the lock key 35*a*. As a result, a part of the top end of lock key 35*a* is spaced apart from the phase-advance side sidewall surface 46*a* of engaging recessed portion 38*a*.

Therefore, by virtue of the second intermediate lock release, it is possible to pull the top end of lock key 35*a* out of the engaging recessed portion 38*a*, minimizing frictional forces between the lock key 35*a* and each of the engaging recessed portion 38*a* and the lock key accommodation chamber 36*a*.

That is, according to the embodiment, the previously-discussed intermediate lock by intermediate lock mechanisms 34*a*, 34*b* can be released such that there is no occurrence of frictional forces between component parts, caused by lock keys 35*a* and 35*b*, each pushed against the inner rotor 21 and the outer rotor 22. Hence, it is possible to more accurately execute releasing of the previously-discussed intermediate lock by intermediate lock mechanisms 34*a*, 34*b*, thereby suppressing the release of the intermediate lock from failing.

Figure 4:
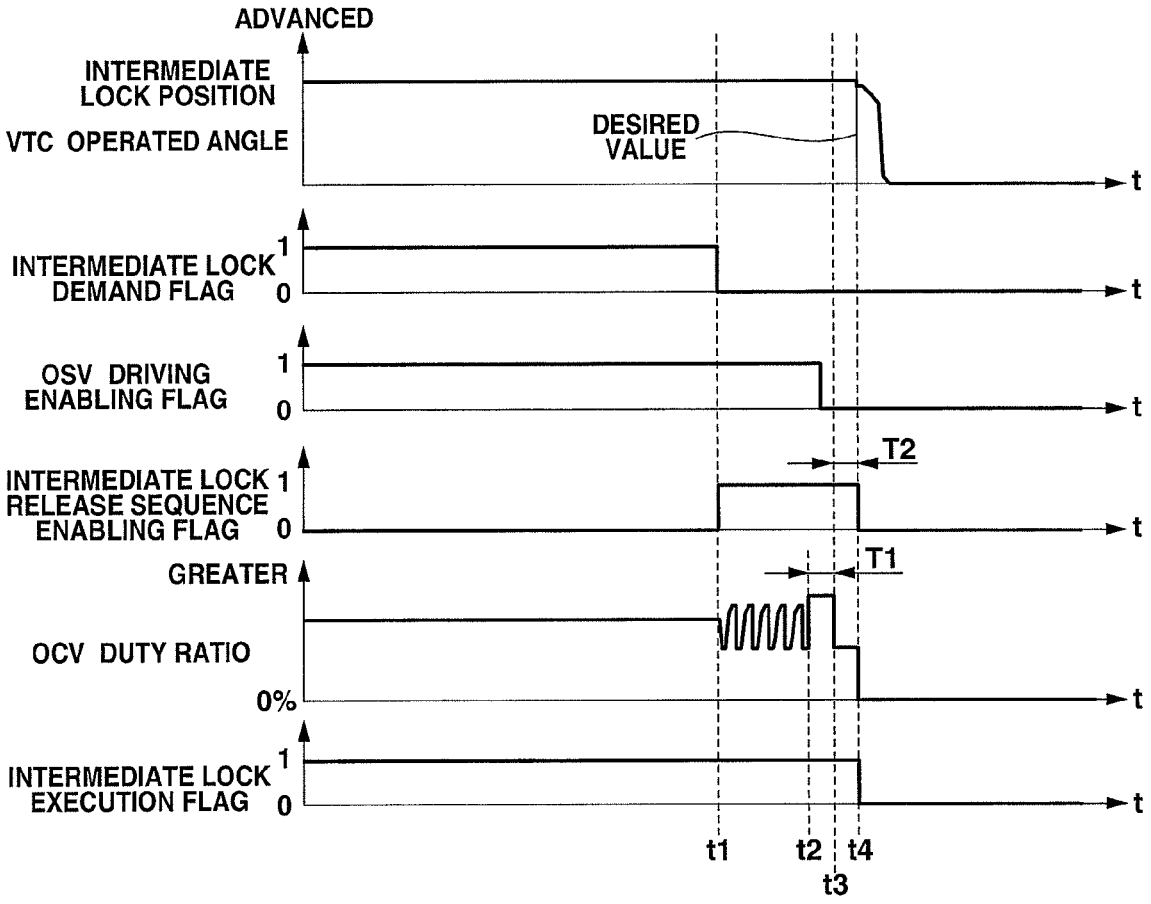
FIG. 4 is a timing chart illustrating one example of operation of a variable valve timing mechanism in the invention.

Referring to FIG. 4, there is shown the timing chart illustrating one example of operation of the variable valve timing mechanism 2 of the embodiment when the intermediate lock by intermediate lock mechanisms 34*a*, 34*b* is released.

At the time t1 when an intermediate lock demand disappears and thus an intermediate lock demand flag becomes reset to "0", an intermediate lock release sequence enabling flag becomes set to "1". Hence, oil control valve 43 executes lock-release preparatory operation by which hydraulic pressure is supplied to the phase-advance side hydraulic chamber 27 and the phase-retard side hydraulic chamber 28 several times in turn, such that the hydraulic pressure in the phase-advance side hydraulic chamber 27 and the hydraulic pressure in the phase-retard side hydraulic chamber 28 are balanced to each other. Hereupon, the previously-discussed intermediate lock demand occurs, for instance when water temperature or oil temperature becomes lower than or equal to a predetermined temperature or when engine revolution speed becomes less than or equal to a predetermined revolution speed R. Such an intermediate lock demand can occur depending on an operating condition, even other than during a start of the internal combustion engine and during a stop of the internal combustion engine.

At the time t2 when the lock-release preparatory operation terminates, the previously-discussed first intermediate lock release is executed during a predetermined time period T1 during which oil control valve 43 is controlled at a predetermined constant duty ratio such that valve timing of the intake valve is adjusted to the phase-advance side with respect to the intermediate lock position.

From the time t3 when the first intermediate lock release terminates, the previously-discussed second intermediate lock release is executed during a predetermined time period T2 during which oil control valve 43 is controlled at a predetermined constant duty ratio such that valve timing of the intake valve is adjusted to the phase-retard side with respect to the intermediate lock position. In the shown embodiment, the time length of the predetermined time period T1 and the time length of the predetermined time period T2 are set to be identical to each other.

At the time t4 when the second intermediate lock release terminates, it is determined that releasing of the intermediate lock by intermediate lock mechanisms 34*a*, 34*b* has been completed, and thus an intermediate lock execution flag becomes reset to "0" and then a desired value of valve timing of the intake valve is changed. On the other hand, the intermediate lock release sequence enabling flag becomes reset to "0" at the time when the second intermediate lock release terminates.

By the way, as previously-discussed, oil switching valve 44 is controlled such that switching from the locked state to the unlocked state occurs after the top end of lock key 35*a* has already been pushed against the phase-advance side sidewall surface 46*a* of engaging recessed portion 38*a* due to the first intermediate lock release, without switching its operating state at the point of time when the first intermediate lock release starts. Hence, an OSV driving enabling flag is switched from "1" used for shifting of oil switching valve 44 to the locked state to "0" used for shifting of oil switching valve 44 to unlocked state during the time interval between the time t2 and the time t3. Therefore, after the time t3, hydraulic pressures, applied to respective lock keys 35*a*, 35*b*, continuously act in the direction for releasing of the intermediate lock. Hence, the intermediate lock of intermediate lock mechanisms 34*a*, 34*b* can be quickly released.

Figure 5:
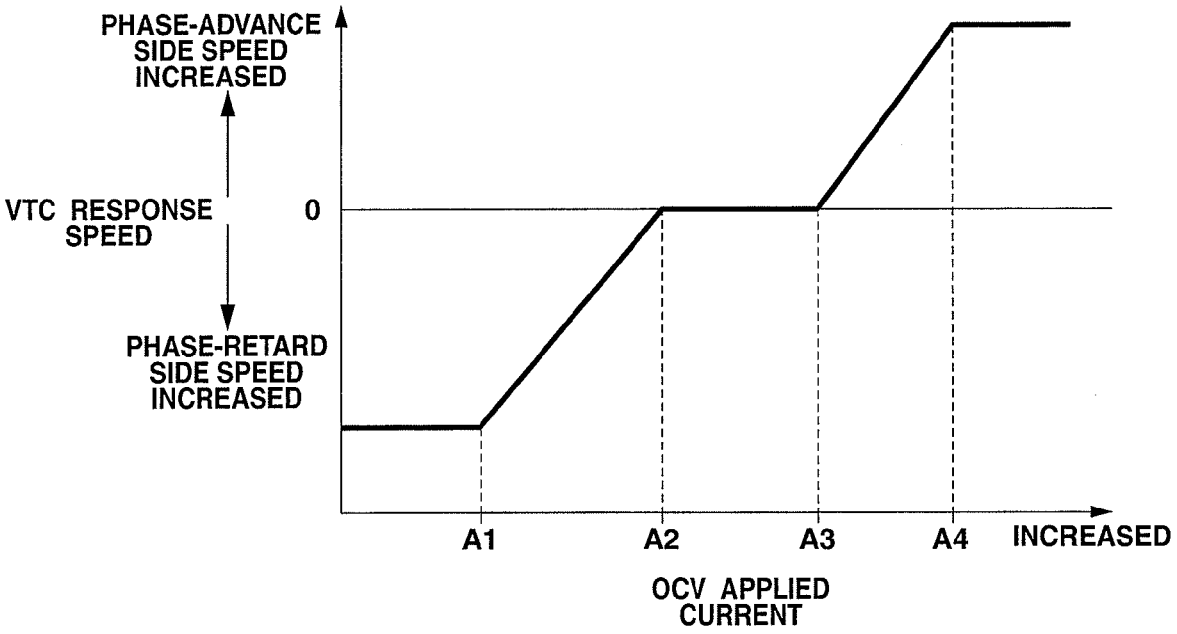
FIG. 5 is an explanatory view illustrating the correlation between an applied current to the oil control valve and a response speed of the variable valve timing mechanism.

By the way, a response speed of variable valve timing mechanism 2 via oil control valve 43 varies as shown in FIG. 5, depending on an applied current value of electric current applied to oil control valve 43. In FIG. 5, a control command value to oil control valve 43 is taken as the axis of abscissa, expressing in terms of a current value equivalent to a duty ratio, rather than in terms of a duty ratio. Assume that the duty ratio increases, as the applied current increases. By the way, the response speed of variable valve timing mechanism 2 is, in other words, equivalent to a rate of change in valve timing of the intake valve.

A phase-retard side speed linear zone (a zone in which the OCV applied current value is greater than or equal to "A1"

and less than "A2"), in which the response speed of variable valve timing mechanism 2 toward the phase-retard side increases as the OCV applied current value decreases, is established, until the OCV applied current value decreases a predetermined current value or more with respect to a central dead zone (a zone in which the OCV applied current value is greater than or equal to "A2" and less than or equal to "A3"). As soon as the applied current value has decreased the predetermined current value or more with respect to the central dead zone, a phase-retard side speed saturation zone (a zone in which the OCV applied current value is less than "A1"), in which the response speed of variable valve timing mechanism 2 toward the phase-retard side becomes a maximum value and is fixed to the phase-retard side maximum speed value, is established. In contrast, a phase-advance side speed linear zone (a zone in which the OCV applied current value is greater than "A3" and less than or equal to "A4"), in which the response speed of variable valve timing mechanism 2 toward the phase-advance side increases as the OCV applied current value increases, is established, until the OCV applied current value increases a predetermined current value or more with respect to the central dead zone (the zone in which the OCV applied current value is greater than or equal to "A2" and less than or equal to "A3"). As soon as the applied current value has increased the predetermined current value or more with respect to the central dead zone, a phase-advance side speed saturation zone (a zone in which the OCV applied current value is greater than "A4"), in which the response speed of variable valve timing mechanism 2 toward the phase-advance side becomes a maximum value and is fixed to the phase-advance side maximum speed value, is established.

For the reasons discussed above, when an OCV applied current value, included within the dead zone, is used as a control command value to oil control valve 43, there is no shift of variable valve timing mechanism 2 to either of the phase-advance side and the phase-retard side.

Therefore, in the shown embodiment, when controlling the oil control valve 43 for the first intermediate lock release and the second intermediate lock release, in order to more certainly shift the response speed of variable valve timing mechanism 2 to the phase-advance side or to the phase-retard side, a duty ratio, corresponding to the OCV applied current value in the phase-retard side speed linear zone or in the phase-advance side speed linear zone, is used. By the way, when using the OCV applied current value in the phase-retard side speed linear zone or in the phase-advance side speed linear zone, it is preferable to use an OCV applied current value at a point of the phase-retard side speed linear zone spaced apart from the central dead zone or at a point of the phase-advance side speed linear zone spaced apart from the central dead zone, fully taking account of individual differences of oil control valves 43 manufactured.

Furthermore, during the second intermediate lock release, a time-to-collision, which corresponds to an elapsed time before the lock key 35*a* of phase-advance side intermediate lock mechanism 34*a* is brought into collision-contact with the phase-retard side sidewall surface 47*a* of engaging recessed portion 38*a*, tends to shorten, as the response speed of variable valve timing mechanism 2 increases. Therefore, there is a possibility that the lock key 35*a* is brought into collision-contact with the phase-retard side sidewall surface 47*a* before the pulling-out movement of the top end of lock key 35*a* from the engaging recessed portion 38*a* has been completed.

That is, in order to pull the top end of lock key 35*a* out of the engaging recessed portion 38*a* before the lock key 35*a* is brought into collision-contact with the phase-retard side sidewall surface 47*a* of engaging recessed portion 38*a* during the second intermediate lock release, it is advantageous to use a lower response speed of variable valve timing mechanism 2 for the second intermediate lock release rather than a higher one. Hence, it is advantageous to use the OCV applied current value in the phase-retard side speed linear zone or in the phase-advance side speed linear zone rather than the OCV applied current value in the phase-retard side speed saturation zone or in the phase-advance side speed saturation zone.

For that reason, in individually setting the response speed of variable valve timing mechanism 2 during the first intermediate lock release and the response speed of variable valve timing mechanism 2 during the second intermediate lock release, it is preferable to set the response speed of variable valve timing mechanism 2 during the second intermediate lock release slower than the response speed of variable valve timing mechanism 2 during the first intermediate lock release. This allows the lock key 35*b* to rapidly move out of engagement with the engaging recessed portion 38*b* during the first intermediate lock release, and also allows the lock key 35*a* to more surely move out of engagement with the engaging recessed portion 38*a* during the second intermediate lock release.

By the way, when setting the response speed of variable valve timing mechanism 2 during the second intermediate lock release slower than the response speed of variable valve timing mechanism 2 during the first intermediate lock release, it is preferable to set the predetermined time period T2 longer than the predetermined time period T1, thereby ensuring a time length needed to surely pull out the top end of lock key 35*a* from the engaging recessed portion 38*a* during the second intermediate lock release regardless of individual response-speed characteristic differences of variable valve timing mechanisms 2 manufactured.

By the way, the response speed of variable valve timing mechanism 2 varies depending on an operating condition (e.g., water temperature, oil temperature, oil pressure, and the like). Thus, the predetermined time periods T1, T2 may be changed depending on the operating condition. For instance, the response speed of variable valve timing mechanism 2 tends to become relatively high, when water temperature or oil temperature becomes high. In such a case, the previously-noted predetermined time periods T1, T2 may be set to relatively shorten.

Moreover, the direction in which valve timing of the intake valve is changed during the first intermediate lock release may be set depending on whether a desired value of valve timing of the intake valve after the intermediate lock by intermediate lock mechanisms 34*a*, 34*b* has been released exists on the phase-advance side or on the phase-retard side with respect to the intermediate lock position.

Figure 6:
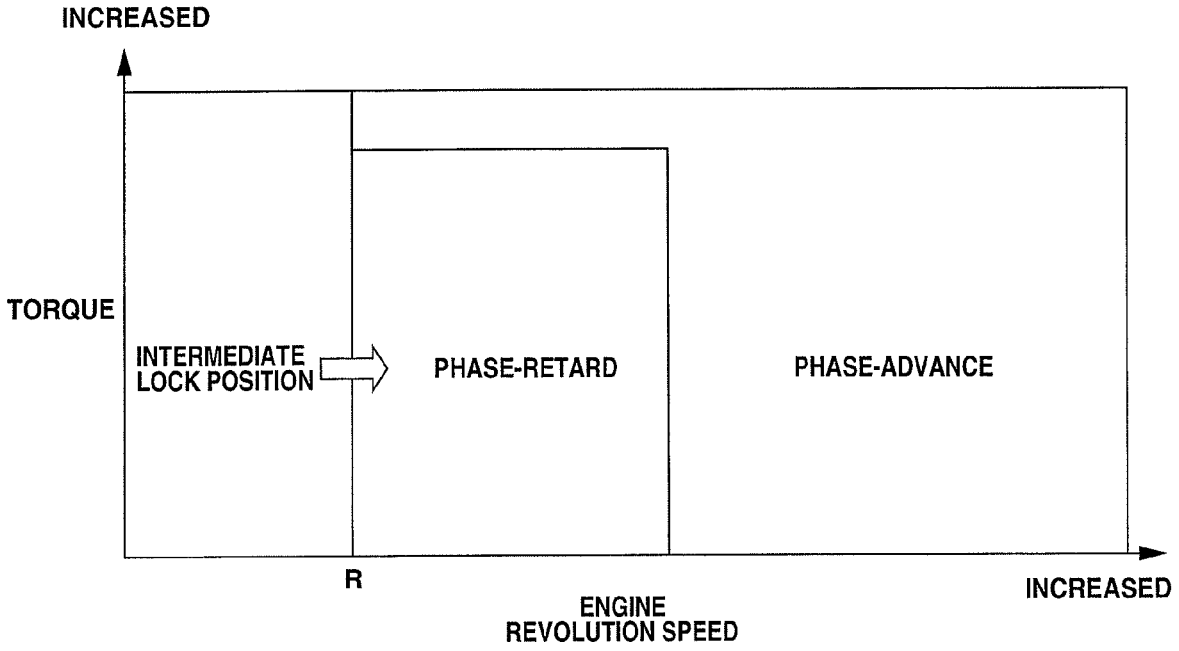
FIG. 6 is an explanatory view schematically illustrating an example of setting of valve timing of an intake valve.

For instance, valve timing of the intake valve is set as shown in FIG. 6, depending on an operating condition. When engine revolution speed becomes greater than the predetermined revolution speed R and thus valve timing of the intake valve changes from an operating condition in which the valve timing is kept at the intermediate lock position to an operating condition in which the valve timing is shifted to the phase-retard side with respect to the intermediate lock position as indicated by the arrow, according to the previously-discussed embodiment, the valve timing of the intake valve is controlled to the phase-advance side with respect to the intermediate lock position during the first intermediate lock release.

Hence, in a transient state where a transition of valve timing of the intake valve from the intermediate lock position to the phase-retard side with respect to the intermediate lock position occurs, it is possible to certainly prevent the valve timing of the intake valve from being shifted to the phase-advance side with respect to the intermediate lock position.

Also, the direction to which the valve timing of the intake valve is controlled during the second intermediate lock release and the direction to which the valve timing of the intake valve is switched from the intermediate lock position are in accord with each other. Hence, it is possible to smoothly achieve switching of valve timing of the intake valve from the intermediate lock position.

By the way, conversely when valve timing of the intake valve changes from an operating condition in which the valve timing is kept at the intermediate lock position to an operating condition in which the valve timing is shifted to the phase-advance side with respect to the intermediate lock position, the valve timing of the intake valve is controlled to the phase-retard side with respect to the intermediate lock position during the first intermediate lock release.

In this case, in a transient state where a transition of valve timing of the intake valve from the intermediate lock position to the phase-advance side with respect to the intermediate lock position occurs, it is possible to certainly prevent the valve timing of the intake valve from being shifted to the phase-retard side with respect to the intermediate lock position. Also, the direction to which the valve timing of the intake valve is controlled during the second intermediate lock release and the direction to which the valve timing of the intake valve is switched from the intermediate lock position are in accord with each other. Hence, it is possible to smoothly achieve switching of valve timing of the intake valve from the intermediate lock position.

In the presence of a great deviation between the detected value of valve timing of the intake valve and the desired value of valve timing of the intake valve immediately after having been set to a value of the phase-advance side or a value of the phase-retard side with respect to the intermediate lock position after the intermediate lock by intermediate lock mechanisms 34*a*, 34*b* has been released, it is determined that a failure in the release of the intermediate lock by intermediate lock mechanisms 34*a*, 34*b* occurs. In such a case, the first intermediate lock release and the second intermediate lock release may be executed again. With the previously-discussed configuration, even when a failure in the release of the intermediate lock by intermediate lock mechanisms 34*a*, 34*b* has occurred, it is possible to re-execute the release of the intermediate lock, thus enabling the intermediate lock to be certainly released.

Figure 7:
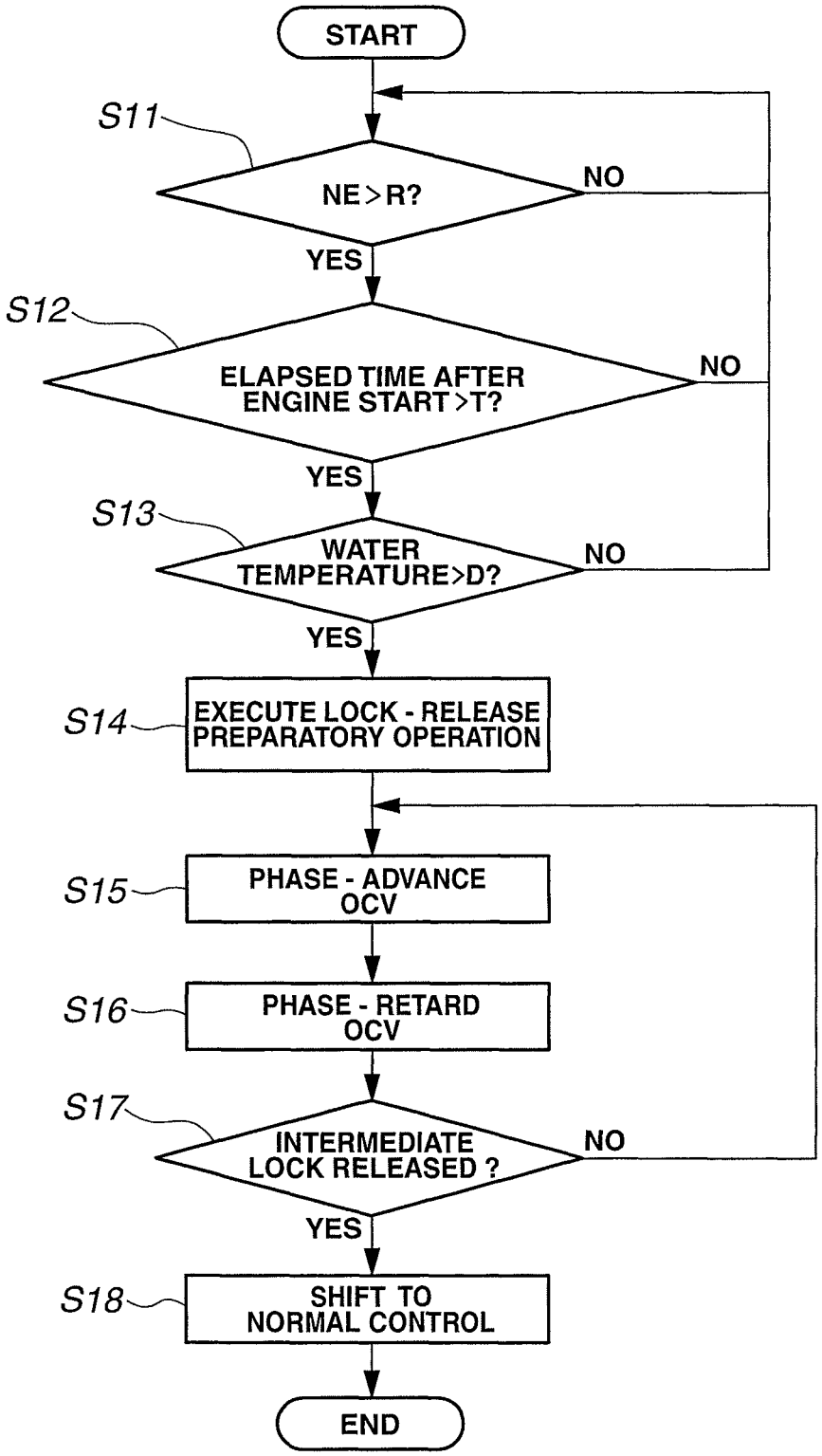
FIG. 7 is a flowchart illustrating a control flow in the embodiment.

Referring to FIG. 7, there is shown the flowchart illustrating a control flow in the embodiment.

Via a series of steps S11-S13, when a condition needed to release the intermediate lock by intermediate lock mechanisms 34*a*, 34*b* is satisfied, the routine proceeds to step S14. At this step, lock-release preparatory operation, by which hydraulic pressure is supplied to the phase-advance side hydraulic chamber 27 and the phase-retard side hydraulic chamber 28 several times in turn, is initiated.

At step S11, a check is made to determine whether the engine revolution speed is greater than the predetermined revolution speed R. At step S12, a check is made to determine whether the time elapsed from a start of the internal combustion engine reaches a predetermined time T. At step S13, a check is made to determine whether the water temperature is higher than a predetermined temperature D.

Immediately when the lock-release preparatory operation terminates through step S14, the routine proceeds to step S15. At step S15, during the predetermined time period T1, oil control valve 43 is controlled at a duty ratio such that valve timing of the intake valve can be certainly shifted to the phase-advance side with respect to the intermediate lock position. Subsequently, at step S16, during the predetermined time period T2, oil control valve 43 is controlled at a duty ratio such that valve timing of the intake valve can be certainly shifted to the phase-retard side with respect to the intermediate lock position. That is to say, step S15 corresponds to the previously-discussed first intermediate lock release, whereas step S16 corresponds to the previously-discussed second intermediate lock release.

At step S17, a check is made to determine whether the intermediate lock by intermediate lock mechanisms 34*a*, 34*b* has been released. When it is determined that the intermediate lock has been released, the routine proceeds to step S18. At this step, the control mode is shifted or switched to normal control in which valve timing of the intake valve is variably controlled to a valve timing value suited to the operating condition.

Conversely when it is determined that the intermediate lock has not yet been released, the routine returns back to step S15, so as to re-execute the first intermediate lock release and the second intermediate lock release.

The invention claimed is:

1. A variable valve timing control device of an internal combustion engine comprising:

a variable valve timing mechanism having a first rotor adapted to rotate together with a camshaft and a second rotor arranged coaxially with the first rotor and adapted to rotate together with a crankshaft, and configured to variably control valve timing of an engine valve by changing a relative rotational phase between the first rotor and the second rotor depending on an operating condition;

an intermediate lock mechanism configured to enable an intermediate lock that holds the valve timing at a predetermined intermediate lock position; and the intermediate lock mechanism having a phase-advance side intermediate-position holding member for restricting a shift of the valve timing from the intermediate lock position to a phase-advance side by engagement with the first rotor and the second rotor, and a phase-retard side intermediate-position holding member for restricting a shift of the valve timing from the intermediate lock position to a phase-retard side by engagement with the first rotor and the second rotor, wherein, when the intermediate lock by the intermediate lock mechanism is released prior to switching of the valve timing from the intermediate lock position due to a change in the operating condition and the valve timing of the engine valve after having been switched is a valve timing value on the phase-retard side with respect to the intermediate lock position, a first intermediate lock release is executed such that the valve timing is controlled to the phase-advance side with respect to the intermediate lock position for moving the phase-retard side intermediate-position holding member out of engagement with the first rotor and the second rotor, and thereafter a second intermediate lock release is executed such that the valve timing is controlled to the phase-retard side with respect to the intermediate lock position for moving the phase-advance side intermediate-position holding member out of engagement with the first rotor and the second rotor; and when the intermediate lock by the intermediate lock mechanism is released prior to switching of the valve timing from the intermediate lock position due to a change in the operating condition and the valve timing of the engine valve after having been switched is a valve timing value on the phase-advance side with respect to the intermediate lock position, the first intermediate lock release is executed such that the valve timing is controlled to the phase-retard side with respect to the intermediate lock position for moving the phase-advance side intermediate-position holding member out of engagement with the first rotor and the second rotor, and thereafter the second intermediate lock release is executed such that the valve timing is controlled to the phase-advance side with respect to the intermediate lock position for moving the phase-retard side intermediate-position holding member out of engagement with the first rotor and the second rotor.

2. A variable valve timing control device of an internal combustion engine as recited in claim 1, wherein:

an oil switching valve is provided for hydraulically releasing the intermediate lock mechanism;

the intermediate lock mechanism comprises:

springs provided for permanently biasing the respective intermediate-position holding members into engagement with the first rotor and the second rotor; and the oil switching valve is configured to apply hydraulic pressures, which are greater than biasing forces of the springs, acting on the respective intermediate-position holding members, to the respective intermediate-position holding members in a direction for releasing the intermediate lock when the intermediate lock is released.

3. A variable valve timing control device of an internal combustion engine as recited in claim 1, wherein:

an oil control valve is provided for hydraulically changing the valve timing; and the oil control valve is configured such that a rate of change in the valve timing during the second intermediate lock release is set to be slower than a rate of change in the valve timing during the first intermediate lock release.

4. A variable valve timing control device of an internal combustion engine as recited in claim 1, wherein:

when there is a great deviation between a detected value of the valve timing and a desired value of the valve timing immediately after having been set to either a value of the phase-advance side or a value of the phase-retard side with respect to the intermediate lock position after the intermediate lock has been released, releasing of the intermediate lock is re-executed.

5. A variable valve timing control device of an internal combustion engine as recited in claim 1, wherein:

an oil control valve is provided for hydraulically changing the valve timing; and the oil control valve is configured such that a time period, during which the valve timing is controlled to one of the phase-advance side and the phase-retard side during the second intermediate lock release, is set to be longer than a time period, during which the valve timing is controlled to the other of the phase-advance side and the phase-retard side during the first intermediate lock release.

* * * * *